United States Patent [19]

Yazawa et al.

[11] 4,240,435

[45] Dec. 23, 1980

[54] HAIR TWEEZERS

[76] Inventors: Toshio Yazawa; Fumi Yazawa, both of 6-11-15, Motogo, Kawaguchi-shi, Saitama-ken, Japan

[21] Appl. No.: 15,666

[22] Filed: Feb. 27, 1979

[30] Foreign Application Priority Data

Oct. 3, 1978 [JP] Japan ..... 53-135842[U]

[51] Int. Cl.[3] ..... A61B 17/30

[52] U.S. Cl. ..... 128/354; 294/99 R

[58] Field of Search ..... 81/43; 294/99, 100; 128/354

[56] References Cited

U.S. PATENT DOCUMENTS

| | | | |
|---|---|---|---|
| 1,036,725 | 8/1912 | Sabo | 128/354 |
| 1,785,919 | 12/1930 | Stickel et al. | 128/354 |
| 2,381,084 | 8/1945 | Slad | 128/354 |

*Primary Examiner*—James G. Smith
*Assistant Examiner*—Roscoe V. Parker, Jr.
*Attorney, Agent, or Firm*—Fleit & Jacobson

[57] ABSTRACT

Hair tweezers comprising a pincette member which is retractable by means of a spiral spring immediately after the pincette member is pressed to grasp an objective hair. The hair tweezers have a cylindrical casing in which there are provided a stopper which locks the pincette member in position against the resilient force of the spiral spring and an actuator assembly such as the aforesaid spiral spring. Buttons each having bearing elements therein are provided at the fore portion of the casing in such a manner that the pincette member is unlocked with the stopper and slidably retracted immediately after the buttons are pressed.

9 Claims, 6 Drawing Figures

HAIR TWEEZERS

BACKGROUND OF THE INVENTION

The present invention relates to tweezers for removing a useless hair for beauty treatment, and gray or white hair.

Conventional tool for the purpose of removing such hairs consists of a pair of legs connected together at one end to form a V shape. When in use, the V shaped legs are pressed generally by a fore-finger and a thumb against a resilient force of the V shaped legs to grasp the objective hair to be removed. While the objective hair is being grasped by the V shaped legs, the tool is moved apart from the skin of a human body to forcibly remove the grasped hair.

It has been widely experienced that a rapid removing of the hair causes a reduction or alleviation of the pain which is generally felt at the time of removing the hair. In order to releave the pain as much as possible, it would be desirable to remove the hair as rapidly as possible. However, the conventional hair tweezers require a considerable tenseness and a prompt action because the hair is grasped first and successively pulled out of the skin while it is being grasped by the tool with the fingers.

Accordingly, an object of the present invention is to provide novel hair tweezers which permit an easy removing action immediately after the hair is grasped.

Another object of the present invention is to provide tweezers which can automatically remove the hair at the same time of grasping the hair.

Another object of the present invention is to provide tweezers in which a hair-grasping operation permits a successive removing operation of the hair.

Additional object of the present invention is to provide tweezers which can remove the hair very rapidly thereby releaving the pain.

SUMMARY OF THE INVENTION

According to the present invention, there is provided tweezers for removing a useless hair for a beauty treatment or the like comprising a cylindrical housing which has openings at an outer end portion thereof, a stopper connected to the inside of the housing, a pincette member which has recesses or holes for engagement with the stopper, button members slidably secured to the openings of the housing, and actuator assembly which comprises a shaft connected to a rear end of the pincette member, first sleeve connected to the housing, second sleeve connected to the shaft end a spiral spring disposed between the first and second sleeves. The button members have bearings such as steel ball or roller to thereby urge a smooth and rapid movement of the pincette member.

DETAILED DESCRIPTION OF THE INVENTION

Figure 1:
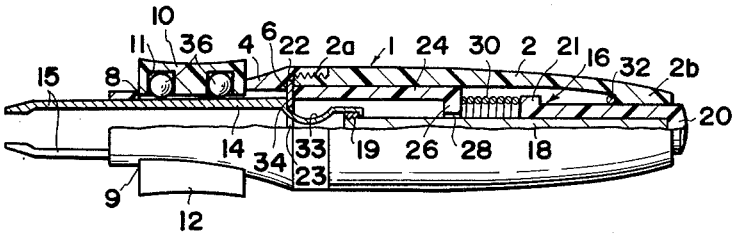
FIG. 1 is a fragmentary sectioned view of tweezers embodying the present invention showing the posture before a hair is grasped.

Like reference numerals represent like parts in the different views of the drawings. Referring now to FIGS. 1 to 4, and more particularly to FIGS. 1 and 2, there is shown a cylindrical housing 1 which includes a barrel 2 formed of any suitable material such, for example, as a plastic. The barrel 2 is a cylindrical tubular member having an externally threaded forward end portion 2*a* for receiving a tubular trim member 4. The rear, inner end of the trim member 4 is provided with an internal thread which mates with the external thread 2*a* of the barrel as shown. The trim member 4 is provided with a shoulder 6 at the rear inner portion thereof and openings 8, 9 at the opposite side for slidably receiving buttons 10, 12 which will be described.

Within the cylindrical casing 1 consisting of the barrel 2 and trim member 4, there are provided a pincers, or pincette member 14 in the fore portion and an actuator assembly 16 in the rear portion. The actuator assembly 16 includes a shaft 18, the front end of which is threadedly connected with the rear end of the pincette member 14 as illustrated at 19, and a cap 20 which firmly receives therein the rear portion of the shaft. The cap 20 has an annular projection 21 at the fore end. At the shoulder 6 is provided a stopper 22 which is annular shaped and has opposite thick portions 22*a*,22*b*. It will be understood that the pincette member 14 is inserted through a hole 23 of the annular stopper 22. On the interior surface of the barrel 2 there is provided a cylindrical sleeve 24 which has a spring receiver 26. The spring receiver has a bore 28 through which the shaft 18 is movably inserted. A spiral spring 30 is disposed around the shaft 18 between the annular projection 21 of the shaft 18 and the spring receiver 26. An O-ring 32 is disposed at the inner rear end of the barrel 2. The O-ring may be replaced by a washer if desired. The barrel 2 has a rear end portion 2*b* which has an inner diameter substantially equal to or slightly larger than the diameter of the cap 20 such that the cap may be moved along the inner wall of the rear end portion 2*b*.

The pincette member 14 has legs 15 each having a tip for grasping the hair. The pincette member 14 has two roundish recesses 33, although one of the recesses is illustrated in the drawings, to form shoulders 34 which will abut against, and contact with the thick portions 22*a*, 22*b* of the stopper 22. The pincette member is made of any suitable metal which is known in the art. Preferably, the pincette member is such formed that the legs from the tip to the recessed portion 33 is thicker or otherwise wider than the remaining rear portion so as to provide a desired resiliency to the pincette member so that a relatively small pressure to the buttons may effectively grasp the hair and release the engagement with the stopper 22.

Figure 2:
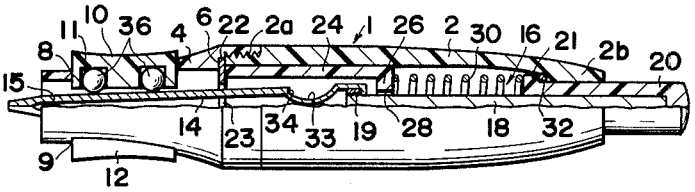
FIG. 2 is a fragmentary sectioned view of the tweezers illustrated in FIG. 1, showing the posture after the hair is grasped and removed.
Figure 3:
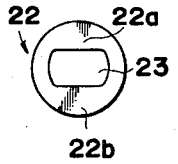
FIG. 3 is a plan view of a stopper, one of the element of the tweezers illustrated in FIGS. 1 and 2.
Figure 4:
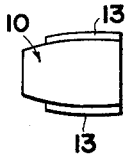
FIG. 4 is a plan view of a pushing element of the tweezers illustrated in FIGS. 1 and 2.

The buttons 10, 12 which are slidable perpendicularly relative to the lengthwise direction of the pincette member 14 have concaves 11 for securing therein bearing such as steel balls 36 and rollers in such a manner that the balls will slightly project inwardly relative to the inner side of the buttons so that the balls slidably and smoothly contact with the pincette member 14. As illustrated in FIGS. 1 and 2, it is desired that each of the buttons has two balls. It will be understood, however, that any number of balls may be provided. The buttons 10, 12 each have, at the lower or inner portion thereof, flanges 13 which extends laterally relative to the lengthwise direction of the pincette member 14 so as to contact the edge portions of the openings 8, 9 to prevent the buttons from being removed from the openings 8, 9.

An operation of the tweezers illustrated in the drawings will be described. Referring now to FIG. 2 which shows a posture that the pincette member 14 is retracted by the force of the spring 30, the cap 20 is first depressed against the resilient force of the spiral spring 30 to urge the shaft 18 and pincette member 14, which has been closed at its tip portions, to advance in the forward direction until the shoulders 34 of the pincette member 14 are engaged with the stopper 22. When the pincette member 14 is advanced and engaged with the stopper, the pincette member which has been closed at its tip portions against its resilient force as illustrated in FIG. 2 is widen apart by its own resilient force as illustrated in FIG. 1. Then, an objective hair is grasped by pushing the buttons 10, 12 and immediately thereafter the engagement between the shoulder 34 of the pincette member 14 and the stopper 22 is released to forcibly retract the pincette member 14 by means of spiral spring 30 with the objective hair being grasped by the tip portions of the pincette member, as illustrated in FIG. 2.

Figure 6:
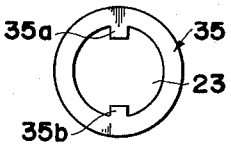
FIG. 6 is a plan view of an element of the tweezers illustrated in FIG. 5.
Figure 5:
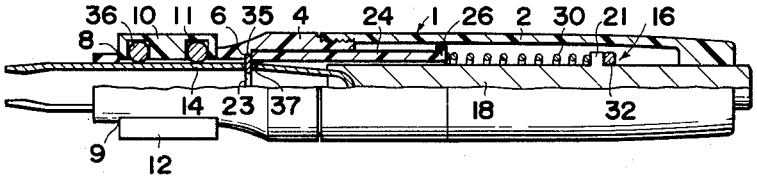
FIG. 5 is a fragmentary sectioned view of tweezers in accordance with another embodiment of the present invention.

In FIGS. 5 and 6 which show another embodiment of the present invention, tweezers have a pincette member 14, and an actuator assembly 16 such as shaft 18 and spring 30 in a cylindrical casing 1 which consists of a barrel 2 and a cylindrical trim member 4. The barrel 2 and the cylindrical trim member 4 are threadedly engaged with each other. The pincette member 14 has holes 37 at substantially middle portion thereof for an engagement with a stopper 35 which will described later, and is connected with the shaft 18 which is made of a plastic by an insert-moulding method. The shaft 18 is cylindrical and has a protrusion 21 on the outer surface of the predetermined position thereof.

The trim member 4 which is an element of the casing 1 has a shoulder 6 on the interior wall thereof for securing the stopper 35. The stopper 35 is annular shaped and has a hole 23 and projections 35*a*, 35*b* which extend in an opposite direction toward a center of the annular stopper as illustrated in FIG. 6. A cylindrical sleeve 24 is provided to the inner wall of the casing 1 as illustrated in FIG. 5 and has a spring receiver 26 at the rear end thereof. A spring 30 is disposed around the shaft 18 between the spring receiver 26 and the protrusion 21 of the shaft 18. The stopper 35 may be of any structure if it can engage with the holes 37 of the pincette member 14, but care must be taken that the engagement between the stopper and the holes 37 should be released immediately after the pincette member grasps the hair.

The cylindrical trim member 4 has openings 8, 9 and buttons 10, 12. The structure of the buttons is substantially equivalent to the elements 10, 12 described with reference to FIGS. 1, 2 and 4, and is secured to the openings 8,9. The buttons have concaves 11 for securing therein cylindrical steel rollers 36.

The shaft 18 has a washer 32 at the rear end of the protrusion 21 which may otherwise be fixed to the inner rear end of the barrel 2. The washer 32 is found to be rather effective for the purpose of sound absorption when the shaft 18 is rapidly retracted in use. If desired, however, the washer 32 may be replaced by an O-ring which has been described with reference to FIGS. 1 and 2.

It will be understood from the foregoing and the drawings that other element and structure in this embodiment is similar with those of the first embodiment shown in FIGS. 1 through 4, and that the operation of the tweezers in this embodiment is substantially equivalent to that of the first embodiment.

According to the present invention wherein a resilient force of a spiral spring is effectively utilized, the pincette member can be retracted with the objective hair being grasped, immediately after, or almost similtaneously, the buttons are pushed for the purpose of grasping the hair. The hair-removing operation can be carried out rapidly since a rapid retraction of the pincette member is ensured by the provision of the steel balls or rollers. Further, according to the tweezers of the present invention, a single operation of pressing the buttons allows a grasping of the hair and removing thereof.

Although the present invention has been described with reference to the preferred embodiments thereof, alterations and modifications may be made within the spirit of the invention.

What is claimed is:

1. Tweezers for removing hair comprising:

a cylindrical housing which has openings at one end portion thereof;

said openings being opposite to each other relative to the axis of said cylindrical housing, a stopper member connected to the inside of said cylindrical housing;

a pincette member which has two symmetrical legs connected with each other at one end thereof;

said pincette member having tips at the other end thereof for securing a hair, buttons secured in said openings of said cylindrical housing;

said pincette member being mounted for lengthwise movement in said housing between a retracted and an advanced position, said pincette member engaging said stopper member when in said advanced position, said buttons each being movable in a perpendicular direction relative to the axis of said housing, said buttons each including therein rolling contact bearing means which roll on the respective legs of said pincette member during lengthwise movements of said pincette member, and an actuator assembly for advancing and retracting said pincette member;

said actuator assembly comprising a shaft connected to the end of said pincette member, a first sleeve disposed on the inside of said housing, a second sleeve connected to said shaft, and a spiral spring disposed between said first and second sleeves, whereby when said buttons are pressed, the pincette member is disengaged from said stopper member to thereby retract said pincette member while said pincette member is holding the hair.

2. The tweezers according to claim 1, in which said cylindrical housing consists of a barrel which has a thread at the outer end thereof, and a tubular trim member which has a thread at the inner end thereof, said thread of the barrel mating with said thread of the trim member.

3. The tweezers according to claim 1, in which said pincette member has recesses to form shoulders, said stopper member being an annular shaped member, said pincette member being inserted through said stopper member, said stopper member having thickened portions at the opposite side for engaging with said shoulders of said pincette member against the force of said spiral spring.

4. The tweezers according to claim 1, in which said pincette member has holes at the legs thereof, said stopper member being an annular shaped member, said pincette member being inserted through said stopper member, said stopper member having projections extending oppositely toward a center thereof, said projections being engageable with said holes of the pincette member against the force of said spiral spring.

5. The tweezers according to claim 1, in which said buttons each have a plurality of concavities and said rolling contact bearing means comprise steel balls rotatably secured within said concavities.

6. The tweezers according to claim 1, which said buttons each have a plurality of concavities and said rolling contact bearing means comprise cylindrical steel rollers rotatably secured within said concavities.

7. The tweezers according to claim 1, in which said shaft has a cap member at the end portion thereof, said second sleeve being formed on the outer end of said cap member.

8. The tweezers according to claim 1, in which said housing has an end portion which has a through-hole having a diameter slightly larger than the diameter of said shaft.

9. The tweezers according to claim 1, in which said buttons each have projections for preventing the buttons from moving out of said openings.

* * * * *